US009513057B2

(12) United States Patent
Pakkala et al.

(10) Patent No.: US 9,513,057 B2
(45) Date of Patent: Dec. 6, 2016

(54) RADIANT CONVECTION OVEN

(75) Inventors: James L. Pakkala, Livonia, MI (US); Joseph M. Klobucar, Ann Arbor, MI (US); Guang Yu, Novi, MI (US)

(73) Assignee: DURR SYSTEMS, INC., Plymouth, MI (US)

( * ) Notice: Subject to any disclaimer, the term of this patent is extended or adjusted under 35 U.S.C. 154(b) by 966 days.

(21) Appl. No.: 12/237,572

(22) Filed: Sep. 25, 2008

(65) Prior Publication Data

US 2009/0017408 A1 Jan. 15, 2009

Related U.S. Application Data

(63) Continuation-in-part of application No. 11/701,254, filed on Feb. 1, 2007, now Pat. No. 7,905,723.

(Continued)

(51) Int. Cl.
*F26B 3/00* (2006.01)
*F27B 9/36* (2006.01)

(Continued)

(52) U.S. Cl.
CPC ..... *F27B 9/36* (2013.01); *F26B 3/283* (2013.01); *F26B 3/305* (2013.01); *F26B 21/004* (2013.01); *F27B 9/10* (2013.01); *B05D 3/0254* (2013.01); *B05D 3/0413* (2013.01); *B05D 7/14* (2013.01); *F26B 2210/12* (2013.01)

(58) Field of Classification Search
USPC ..... 432/145, 147, 143, 175; 34/270, 666, 34/267; 126/21 A; 106/310
See application file for complete search history.

(56) References Cited

U.S. PATENT DOCUMENTS 2,472,293 A * 6/1949 Groven ..... 34/60
4,092,100 A 5/1978 Phillips (Continued)

FOREIGN PATENT DOCUMENTS

| | | |
|---|---|---|
| JP | 62213873 | 9/1987 |
| JP | H02-061491 | 3/1990 |
| JP | 2003-343978 | 12/2003 |

OTHER PUBLICATIONS

International Search Report for international application No. PCT/EP2007/005250.

(Continued)

*Primary Examiner* — Alissa Tompkins
*Assistant Examiner* — John Bargero
(74) *Attorney, Agent, or Firm* — Warner Norcross & Judd LLP

(57) ABSTRACT

A radiant convection oven for baking a coating on an article which includes an oven enclosure receiving coating articles, a fan receiving fresh air and directing the fresh air to a burner or burners, a plurality of heat radiators each having an internal chamber receiving heated fresh air from the burner. The radiators are located within the oven opposite a coating article, radiating heat energy to the coated article, and a plurality of nozzles connected to the internal chamber of the radiators directing fresh heated onto the article, transferring convection heat energy to the coated article. In the disclosed embodiment, the radiators include radiating side and bottom walls having a relatively shallow depth, increasing the flow rate through the radiators, reducing the size and cost of the radiators and the fan.

5 Claims, 2 Drawing Sheets

Related U.S. Application Data

(60) Provisional application No. 60/995,542, filed on Sep. 27, 2007, provisional application No. 60/814,632, filed on Jun. 16, 2006, provisional application No. 60/807,875, filed on Jul. 20, 2006, provisional application No. 60/839,082, filed on Aug. 21, 2006.

(51) Int. Cl.

| | |
|---|---|
| ***F26B 3/28*** | (2006.01) |
| ***F26B 3/30*** | (2006.01) |
| ***F26B 21/00*** | (2006.01) |
| ***F27B 9/10*** | (2006.01) |
| *B05D 3/02* | (2006.01) |
| *B05D 3/04* | (2006.01) |
| *B05D 7/14* | (2006.01) |

(56) References Cited

U.S. PATENT DOCUMENTS

| | | | | |
|---|---|---|---|---|
| 4,242,807 | A | | 1/1981 | Braun |
| 4,416,068 | A | * | 11/1983 | Nilsson et al. ..... 34/267 |
| 4,493,641 | A | * | 1/1985 | Hubbert ..... 432/120 |
| 4,656,758 | A | | 4/1987 | Nakayama |
| 4,849,598 | A | * | 7/1989 | Nozaki et al. ..... 219/601 |
| 4,878,480 | A | | 11/1989 | Watson et al. |
| 4,967,487 | A | * | 11/1990 | Urquhart ..... 34/66 |
| 5,070,625 | A | * | 12/1991 | Urquhart ..... 34/268 |
| 5,235,757 | A | | 8/1993 | Josefsson et al. |
| 5,588,830 | A | | 12/1996 | Josefsson et al. |
| 5,690,485 | A | | 11/1997 | Mangham et al. |
| 5,795,146 | A | | 8/1998 | Orbeck |
| 6,062,850 | A | * | 5/2000 | Ino et al. ..... 432/143 |
| 6,192,604 | B1 | * | 2/2001 | Morrison ..... 34/666 |
| 6,935,052 | B2 | * | 8/2005 | Sonner et al. ..... 34/666 |
| 6,990,749 | B2 | | 1/2006 | Roesler et al. |
| 7,104,789 | B1 | * | 9/2006 | Robich et al. ..... 432/248 |
| 7,200,953 | B2 | * | 4/2007 | Sonner et al. ..... 34/225 |
| 2004/0076919 | A1 | * | 4/2004 | Schwartz ..... 432/175 |
| 2005/0087183 | A1 | * | 4/2005 | Klobucar et al. ..... 126/21 A |
| 2007/0292815 | A1 | | 12/2007 | Klobucar et al. |

OTHER PUBLICATIONS

Japanese Patent Office Notification of Reasons for Rejection, reference No. B086503, mailing No. 046441, mailing date Jan. 29, 2013, 7 pages.

* cited by examiner

RADIANT CONVECTION OVEN

RELATED APPLICATIONS

This non-provisional patent application claims priority to a provisional patent application Ser. No. 60/995,542, filed on Sep. 27, 2007 and is a continuation-in-part application of Ser. No. 11/701,254 filed on Feb. 1, 2007, which application claims priority to provisional application Ser. Nos. 60/814,632, filed Jun. 16, 2006 and 60/807,875, filed Jul. 20, 2006 and 60/839,082, filed Aug. 21, 2006.

FIELD OF THE INVENTION

This invention relates to a radiant convection oven for baking or curing a coating on an article. As used herein, the term "baking" is defined as heating an object or article for the purpose of drying or curing the coating, including paint. Paint is defined as a decorative, protective or performance enhancing coating or sealant.

BACKGROUND OF THE INVENTION

A paint bake oven typically includes an oven enclosure into which coated articles are received, typically on a conveyor, a heating system to provide heat for drying or curing the coating and an exhaust system to ventilate fumes and smoke from the oven enclosure. The heating system provides thermal energy to the oven and transfers that thermal energy to the coated object or article. There are two types of heating systems presently in wide use for paint bake ovens of this type, namely convection and radiation. Occasionally, a combination of convection and radiant ovens are used.

A convection heating system transfers heat to the coated object or article by blowing heated convection air onto the coated article, transferring convection heat energy to the coated article. The volumetric flow rate, temperature and velocity of the convection air are controlled to provide the desired rate of heat gain in the coated object. A convection heating system includes a fan or blower for moving the convection air and a heat source for heating the convection air. Filtration is often provided in the convection heating system to remove dirt particles from the convection air before it is blown onto the coated object.

A radiant heating system transfers heat to the coated article by positioning a hot radiator or radiating wall or duct adjacent the coated object. Electromagnetic radiation, primarily in the form of infrared radiation, is exchanged between the radiator and the object. The radiator size, distance from the object and temperature of the radiator are controlled to provide desired rate of heat gain to the coated object. The radiator is typically a metal wall or panel that is heated by circulating hot air into a space behind the radiator from typically a passage or chamber within the radiator. A radiant heating system, similar to a direct fired convection heating system, heats and circulates the hot air inside a passage or chamber within the radiator. Typically, a radiant heating system will include some convection heating directed at specific heavy metal areas. For automotive bodies, for example, this convection heat is directed at the door sill area. The door sill area is typically made from multiple layers of thicker material, such as steel, and the radiant heating alone is not sufficient to properly heat this area. The convection air may also be directed from a fresh supply for the radiant portion of the oven.

In either type of heating system, a heater box is typically used to house the filters and a heat exchanger (if required) to provide a place to connect the recirculation fan and burner. The heater box also provides a closed space to allow mixing of the burner heat with the recirculating air. The heater box is connected to the oven enclosure by ductwork for conveying air between the oven and the heater box. The heater box or boxes must be insulated to reduce heat loss and reduce the burn hazard to personnel in the area. Further, regardless of the type of heating system used, fresh air make-up is required for the oven. The purpose of fresh air make-up is to replace the air removed from the oven enclosure by the oven exhaust system used to remove combustible gases. With a conventional heating system, the fresh hair make-up is provided by drawing some pressure into the convection heater box. With a radiant heating system, fresh air is provided by a separate fresh air heating system. The fresh air heating system is essentially a convection system with capacity sufficient for the fresh air needs of the oven. It is also possible to allow fresh air to leak into the oven without heating; but this is generally not done because (1) it can lead to condensation problems when the cold air mixes with the hot air inside the oven, and (2) may carry dirt into the oven which would contaminate the coated article.

SUMMARY OF THE INVENTION

As set forth above, this invention relates to a radiant convection oven for baking a coating on an article, such as the paint on a vehicle body. The new heating system used in the convection radiant oven of this invention may use the fresh air make-up only to transfer heat to the coated object or article. The fresh air make-up is used to both heat the radiators and is then delivered to the oven as convection air. In addition, this air is heated by burners mounted to the oven enclosure instead of a separate heater box.

The radiant convection oven for baking a coating on an article of this invention includes an oven enclosure receiving the coated articles, a plurality of radiators, including heat radiating walls, having an internal chamber receiving heated air from the burner, wherein the radiators are located within the oven opposite the coated article, radiating heat energy to the article, and a plurality of nozzles in communication with the internal chamber of the radiators, directing fresh heated air under pressure onto the coated article, transferring convection heat energy to the article. As would be understood by those skilled in this art, for the radiant convection oven of this invention to a heat a coated object at the same rate as a conventional radiant heating system, it must produce an equivalent amount of radiant and convection energy delivered to the coated object surface as does a conventional radiant oven. This is accomplished when the convection air volume, temperature and velocity as well as the size, position, surface temperature and emissivity of the radiators are generally equal.

In the radiant convection oven of this invention, the volumetric flow rate of the fresh air make-up is small compared to the recirculating air flow rate in a convectional oven radiator. Therefore, the temperature of the air circulating through the inventive oven radiator must be greater than the air circulated through a conventional radiant oven. The temperature and velocity of the radiator air for the radiant convection oven of this invention has been designed to provide radiation heat delivery equal to a convection radiant heat oven as described in more detail below.

In the disclosed embodiment of the radiant convection oven of this invention, the internal chamber of the radiating walls has a depth of less than five inches and an air velocity of greater than two thousand feet per minute. More preferably, the velocity of the air through the internal chamber of the radiating walls has a velocity of greater than two thousand five hundred feet per minute and may exceed three thousand feet per minute and the depth of the radiating walls or radiator may be three to five inches or less, significantly reducing the requirement for fresh make-up air while maintaining radiation heat delivered to the coated article equal to conventional radiant bake ovens. Further, in the disclosed embodiment, the internal chamber of the radiating walls have an air volume flow rate of less than five thousand cubic feet per minute. In the disclosed embodiment of the radiant convection oven of this invention, the burner is located outside of the oven enclosure, preferably adjacent or attached to the oven enclosure, and the oven includes a combustion chamber located within the oven receiving hot combustion gas from the burner. In the enclosed embodiment, the radiant convection oven includes two burners, including a burner located adjacent each side wall of the enclosure and the radiating walls include a bottom wall and radiating sidewalls on opposed sides of the oven. Further, the disclosed embodiment of the convection radiant oven of this invention includes radiant ducts on opposed sides of the oven, adjacent the sill area of the vehicle body, receiving hot fresh air from the radiating side walls, directing hot convection air onto the coated article, such as the sill area of a coated vehicle body.

As would be understood by those skilled in this art, various modifications may made to the radiant convection oven of this invention within the purview of the appended claims and the following description of the preferred embodiments and the appended drawings are for illustrative purposes only and do not limit the invention as claimed.

DETAILED DESCRIPTION OF THE PREFERRED EMBODIMENT

As set forth above, the radiant convection oven of this invention utilizes fresh air make-up to transfer heat to the coated object. The fresh air make-up is used to the heat radiators and is then delivered to the oven by the radiators as convection air. In the disclosed embodiment, the fresh air is heated by burners mounted to the oven enclosure instead of a separate heater box. The radiant convection oven of this invention may be used for baking or curing any coating on an object, including but not limited to decorative and protective coatings and adhesives as used, for example, by the automotive industry. Although the radiant convection bake oven of this invention may be utilized for any application, it is particularly useful for mass production applications, such as utilized by the automotive industry to cure paint and adhesives on an automotive body. In order for the radiant convection oven of this invention to heat a coated object at the same rate as a conventional radiant heat oven, it must produce an equivalent amount of radiant and convection energy delivered to an object as does a conventional radiant oven. This is accomplished when the convection air volume, temperature and velocity as well as the size, position, surface temperature and emissivity of the radiators are generally equal.

Figure 1:
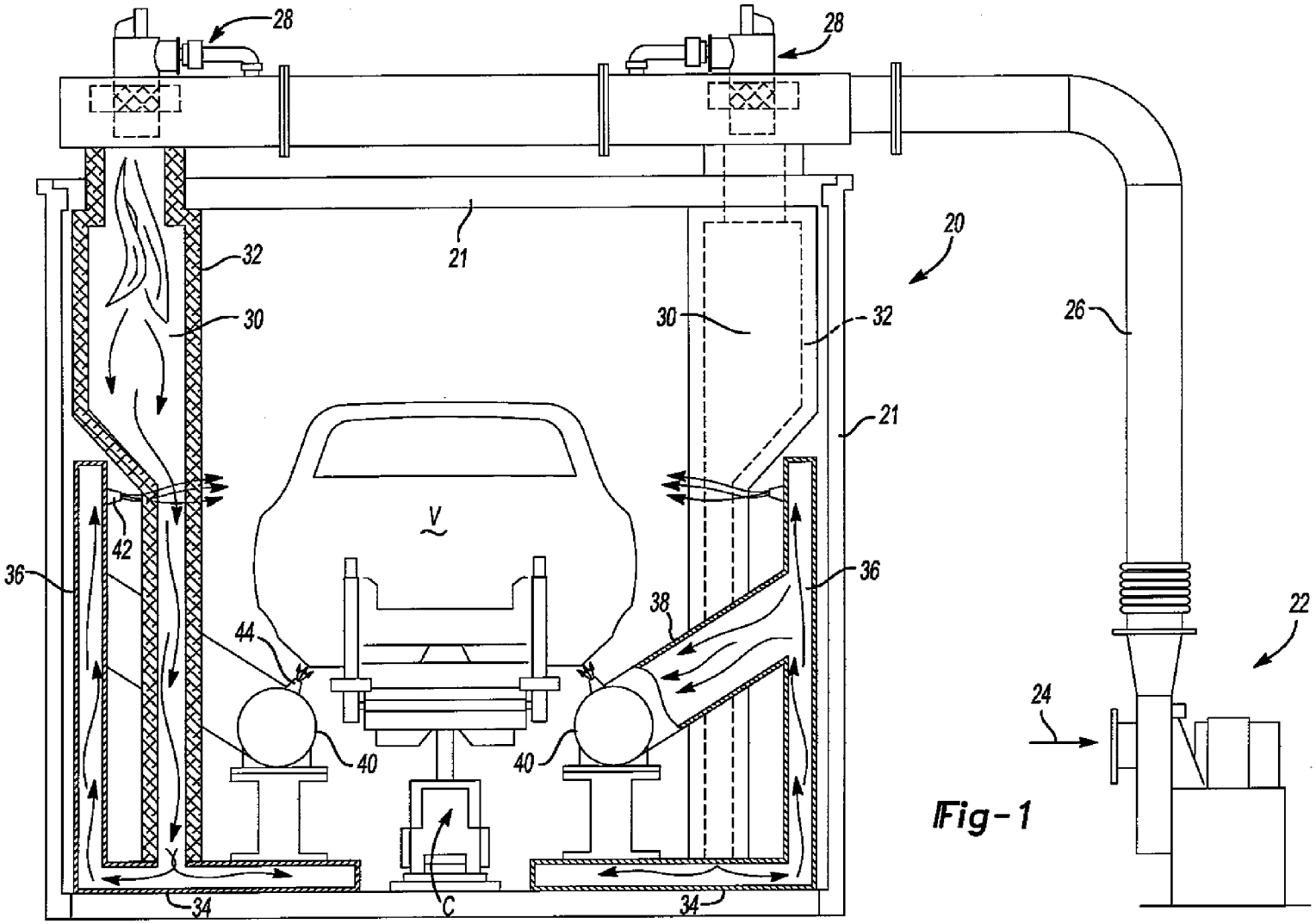
FIG. 1 is a side, partially cross-sectioned, partially-schematic view of one embodiment of the radiant convection oven of this invention.
Figure 2:
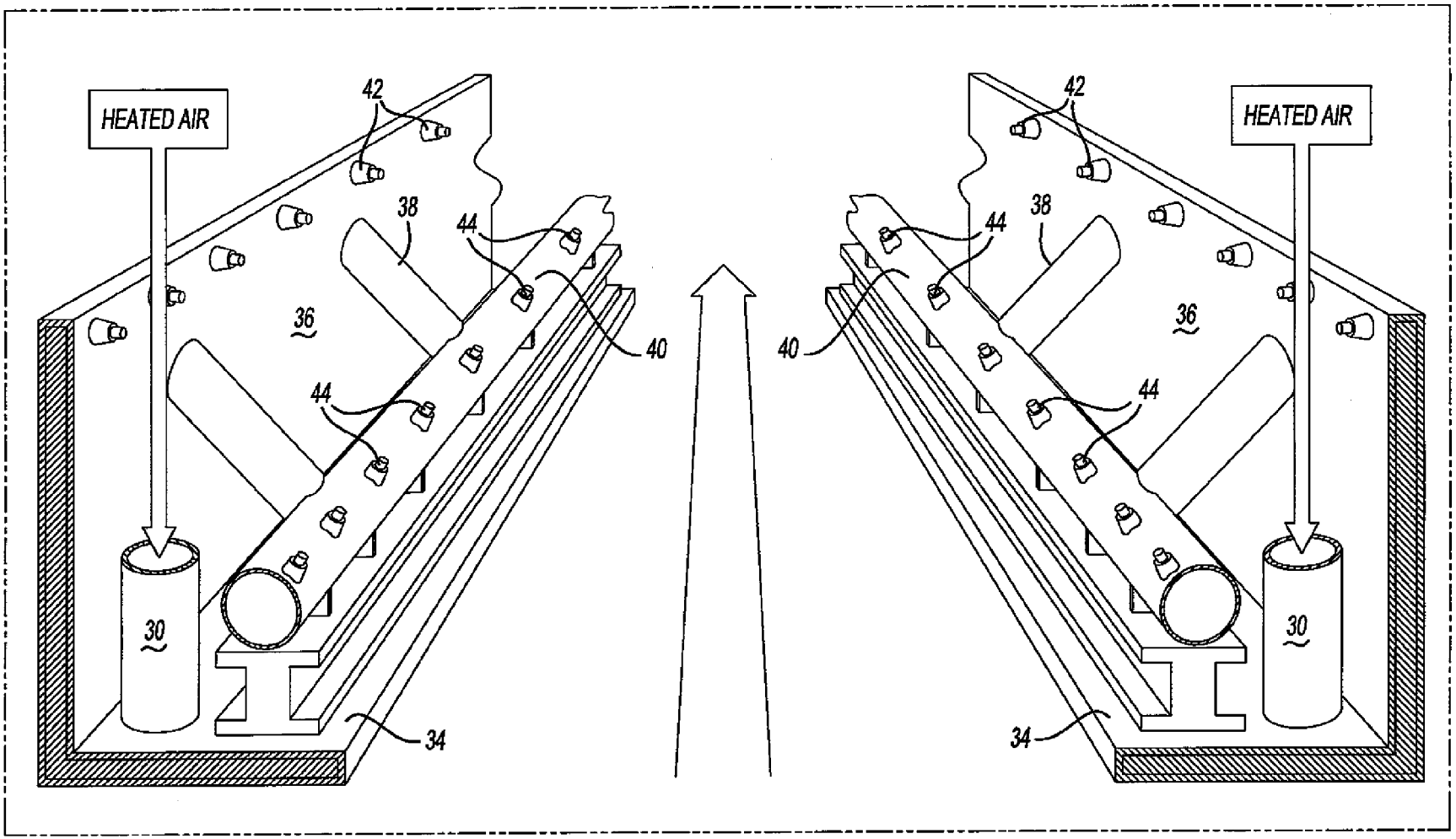
FIG. 2 is a partial end elevation of the radiant convection shown in FIG. 1.

FIGS. 1 and 2 illustrate one embodiment of the radiant convection oven of this invention. As set forth above, however, the disclosed embodiments are for illustrative purposes only and do not limit this invention except as set forth in the appended claims.

The embodiment of the radiant convection oven 20 shown in FIGS. 1 and 2 includes an oven enclosure 21 which may be conventional. A typical paint bake oven used by the automotive industry has a length of about eighty to one hundred feet or greater. A fan or blower 22 shown in FIG. 1 draws fresh air as shown by arrow 24 preferably through a filter (not shown) and delivers fresh air under pressure through duct 26 to combustion burners 28. However, as discussed further below, the radiant convection oven of this invention may include only one burner or more than two burners depending upon requirements of the application. A portion of the fresh air goes through the burner or burners 28 as combustion air and a portion may bypass the burner and mix downstream in the combustion chambers 30. The heated air mixture enters insulated combustion chamber 30 located inside the oven enclosure 21 for distribution to a plurality of radiators. Within a preferred embodiment, the combustion chambers 30 include the insulated walls 32 to avoid overheating light metal parts of the vehicle body that pass close to the combustion chambers 30. The design of the combustion chambers 30 should be such that there is adequate mixing of the burner heat before air enters the radiators. In the disclosed embodiment, the hot fresh air from the combustion chambers 30 pass through the radiators in one or several passes. A three-radiator configuration is illustrated in FIG. 1.

The hot fresh air and combustion gases are delivered from the combustion chambers 30 to three types of radiators. The hot fresh air is delivered through the first radiators 34, which, in the disclosed embodiment, are radiating bottom walls. The hot fresh air is then delivered from the first radiators 34 to the second radiators 36 which, in the disclosed embodiment, are radiating sidewalls. The hot fresh air is then delivered through duct 38 to the third radiators 40 which, in the disclosed embodiment, are horizontal ducts 40 which extend the length of the paint oven as best shown in FIG. 2. As will be understood from FIG. 1, the primary function of the horizontal ducts 40 is to delivery heated fresh air from the radiators 36 to the coated article through nozzles 44. However, the heated ducts 40 also radiate heat to the coated article. Thus, the radiant convection oven 20 in the disclosed embodiment includes three radiators, including the radiating bottom walls 34, the radiating sidewalls 36 and the radiating horizontal ducts 40. As will be understood, the preferred location and orientation of the radiators will depend upon the application. In this embodiment, wherein a vehicle body "V" is conveyed through the oven on a conveyor "C," the horizontal radiating ducts 44 are located adjacent the sill area of the vehicle body and hot fresh air is directed to the sill area by the nozzles 44 because of the greater requirement for heating the multi-layered metal sill area as would be understood by those skilled in this art. The nozzles 42 are communicating with the interior of the radiating sidewalls 36 direct heated fresh air through the lighter metal areas of the vehicle body. Thus, as will be understood by those skilled in this art. The location and orientation of the radiators and the nozzles will depend upon the particular application.

As set forth above, the volumetric flow rate of the fresh air is relatively small in the disclosed embodiment of the radiant convection oven 20 of this invention compared to the recycling air flow rate in a conventional radiant oven. Thus, the temperature of the air circulating through the oven radiators must be greater than the air circulated through the conventional radiators. Table 1 below compares the radiator flow rate, temperature and velocity for a single, eighty-foot long zone of conventional automotive radiation oven to that of the radiant convection oven of this invention. The temperature and velocity of the radiated air for the radiant convection oven of this invention has been selected to provide radiation heat delivery equal to a conventional design.

TABLE 1

| | | Conventional | New |
|---|---|---|---|
| Heat Delivered by Radiators | BTU/hr | 578,700 | 578,700 |
| Radiator Air Volume - Actual | acfm | 15,000 | 4,673 |
| Radiator Air Volume - Standard | scfm | 8,325 | 2,435 |
| Radiator Air Inlet | F | 495 | 557 |
| Radiator Surface Area | ft2/ft-oven | 10 | 10 |
| Radiator Depth | In | 16 | 3 |
| Radiator Air Velocity | fpm | 800-1,500 | 2,470-3,115 |
| Sill Convection Air Temperature | F | 325 | 325 |
| Sill Convection Air Volume - Standard | scfm | 2,435 | 2,435 |

As shown in Table 1, the radiator air volume of the radiant convection oven of this invention is significantly reduced compared to a conventional radiator air volume. The radiators for the radiant convection oven of this invention are also designed so that the temperature of the air exiting from the radiators is at the same temperature as the sill convection air for a conventional radiation oven. In this way, the sill convection air nozzles 44 may be of the same design as a conventional radiant oven resulting in equal performance.

The radiant convection oven of this invention has several important advantages over conventional radiant paint ovens. First, the reduced volumetric flow rate of the radiators heating air reduces the size of the radiator panels or walls 34, 36 within the oven enclosure. This not only reduces the cost of the radiators, but also allows the oven enclosure to be smaller in size, further reducing the cost. The reduced radiator heating air volume further reduces the size of the fan necessary to move fresh air as part of the heating system. Because the heating system is a "once-through system" rather than a recirculating heating system, the fan 22 moves ambient temperature fresh air (from ~70° F.) instead of radiated outlet temperature air (~350° F.). This further reduces the size of the fan. Further, because the fan is operating at a lower temperature, it is simpler and less costly construction. The combination of lower air volume and temperature results in a reduced electrical power consumption for the fan, even though the fan for the radiant convection oven of this invention delivers it at a higher pressure. Another advantage of the radiant convection oven of this invention is that the heated box and associated ductwork is eliminated, further reducing costs. The elimination of the heater box and ductwork also eliminates the heat losses associated with its components, further reducing the fuel consumption of the oven and the cost. In addition, the elimination of the heater box eliminates any burn hazard associated with the hot surfaces.

As set forth above, various modifications may be made to the disclosed embodiment of the radiant convection oven of this invention within the purview of the appended claims. For example, after exiting the radiators, the fresh air may be directed to a heated ceiling. A heated ceiling is often used at the entrance and exit of a paint bake oven to prevent condensation on the ceiling. Condensation on the ceiling in this area is known to drip onto the object being baked and ruin the finish. If this is done, air exiting the radiators ducted to a hard cavity over the ceiling of the oven entrance or exit. In another alternative design, the air exiting the radiators may be directed to an air seal. An air seal is a system that blows a curtain of air across the open ends of the oven to prevent smoke and fumes from the oven from drifting out of the oven enclosure into the paint shop general area. Another option for controlling the radiation intensity is to manufacture the radiators with an internal shield between the hot air and the radiator surface. This may be accomplished by making a second internal radiator wall in the area where it is desired to reduce the radiation intensity. The hot fresh air may also be channeled through the radiating walls by channels located within the walls to provide a multiple pass radiator. Temperature sensors may also be provided in the combustion chamber to monitor the temperature of the hot air entering the radiator panels. The signal from the sensor is then used to control the heat output from the burners. Finally, as set forth above, a single burner channeling combustion air into the combustion chambers 30 may be preferred in certain applications. However, in a preferred embodiment of the radiant convection oven of this invention, the burners 28 are preferably located on the upper wall of the oven enclosure 21 as shown in FIG. 1 or on one or both of the sidewalls of the oven enclosure. Having described the preferred embodiment of the radiant convection oven of this invention, the invention is now claimed as found.

What is claimed is:

1. A radiant and convection oven for baking a coating on an article, comprising: an oven enclosure open at both ends receiving coated articles on a conveyor continuously conveying the articles through the oven enclosure; a source of fresh air consisting essentially of atmospheric fresh air, a fan directing the fresh air under pressure to a burner, heating the fresh air; the burner directing the heated fresh air to an insulated combustion chamber; and a plurality of panel shaped, generally enclosed horizontal radiators adjacent to a flow of said oven delivering hot fresh air to a plurality of panel-shaped, generally vertical generally enclosed vertical radiators on opposed sides of the conveyor having a radiator air volumetric flow rate of less than about 5,000 acfm, each vertical and horizontal radiator having a shallow internal chamber having a length substantially greater than its width receiving heated fresh air under pressure from the insulated combustion chamber via a connection to the horizontal radiators, the walls of the panel-shaped radiators radiating heat to the coated article on the conveyor, and the panel-shaped vertical radiators each having a plurality of gas nozzles directing convection heated fresh air onto coated articles on the conveyor; gas flow passages directing the fresh air flowing under pressure in series from the fan through the insulated combustion chamber to the panel-shaped radiators and through the plurality of gas nozzles onto the coated article and out of the system, in a single pass, once through heating system, and the heated fresh air being the only source of heating of the coated articles in the oven enclosure.

2. The radiant convection oven as defined in claim 1, wherein heated fresh air in the panel-shaped radiators is directed under pressure by the gas flow passages to horizontal radiators extending parallel to the conveyor adjacent a lower portion of the conveyor radiating heat to the lower portion of coated articles on the conveyor.

3. The radiant convection oven as defined in claim 1, wherein the gas flow rate through the panel shaped radiators is between 2,000 and 5,000 cubic feet per minute.

4. The radiant convection oven as defined in claim 1, wherein the burner is located outside the oven enclosure and the insulated combustion chamber is located within the oven enclosure.

5. The radiant convection oven as defined in claim 1, wherein the panel-shaped radiators have generally parallel walls and the shallow internal chamber has a width of five inches or less.

* * * * *